US006281782B1

(12) United States Patent
Morimoto et al.

(10) Patent No.: US 6,281,782 B1
(45) Date of Patent: Aug. 28, 2001

(54) CIRCUIT BREAKER

(75) Inventors: Mitsuaki Morimoto; Noboru Yamaguchi, both of Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/440,095

(22) Filed: Nov. 15, 1999

(30) Foreign Application Priority Data

Nov. 16, 1998 (JP) ..... 10-325607
May 26, 1999 (JP) ..... 11-146934

(51) Int. Cl.[7] ..... H01H 37/76; H01H 85/55

(52) U.S. Cl. ..... 337/401; 337/405; 337/182; 337/185; 361/11.5

(58) Field of Search ..... 337/157, 401, 337/182, 404–409, 185; 307/9.1–10.8, 119; 180/271, 274, 279, 281–283; 200/61.08; 361/115; 280/227

(56) References Cited

U.S. PATENT DOCUMENTS 2,798,921 * 7/1957 Haas ..... 200/123
3,698,323 * 10/1972 Apstein et al. ..... 102/70.2 R
3,748,413 * 7/1973 Sawyer ..... 200/61.08
3,958,206 * 5/1976 Klint ..... 337/406
4,124,835 * 11/1978 Cahill, Jr. ..... 337/1
4,150,266 * 4/1979 Patrichi ..... 200/61.08
4,224,487 * 9/1980 Simonsen ..... 200/61.08
4,311,890 * 1/1982 Schroder ..... 200/61.08
4,821,010 * 4/1989 Plasko ..... 337/405
5,535,842 * 7/1996 Ritcher et al. ..... 180/279
5,877,563 * 3/1999 Krappel et al. ..... 307/10.1

FOREIGN PATENT DOCUMENTS 10-55742-A * 2/1998 (JP) ..... H01H/39/00
10-241523-A * 9/1998 (JP) ..... H01H/39/00
10-241524-A * 9/1998 (JP) ..... H01H/39/00

* cited by examiner

*Primary Examiner*—Leo P. Picard
*Assistant Examiner*—Anatoly Vortman
(74) *Attorney, Agent, or Firm*—Finnegan, Henderson, Farabow, Garrett & Dunner, L.L.P.

(57) ABSTRACT

The circuit breaker disclosed in the invention comprises a first connection terminal, a second connection terminal, a heat generating part having conductivity disposed between the first connection terminal and second connection terminal, an igniting part igniting depending on a cut-off signal, an expandable elastic member capable of applying a force to the heat generating part so as to be departed from between the first connection terminal and second connection terminal, and a holding part for holding the elastic member in compressed state. Herein, as the igniting part ignites depending on the cut-off signal and the heat generating part generates heat, when the holding part releases the elastic member, the elastic member applies force to the heat generating part, and the heat generating part is departed from between the first connection terminal and second connection terminal, the conductive state between the first connection terminal and second connection terminal is cut off.

12 Claims, 8 Drawing Sheets

CIRCUIT BREAKER

BACKGROUND OF THE INVENTION

The present invention relates to a circuit breaker, and more particularly to a circuit breaker for cutting off an electric circuit in a short time.

In an electric equipment system installed in a vehicle, if any abnormality should occur due to load of power window or the like, or if any abnormality should occur in the wire harness or the like composed of plural wires connecting the battery and each load, a large-current fuse interposed between the battery and the wire harness is melted to cut off between the battery and the wire harness, thereby preventing the loads and wire harness from burning down.

In the electric equipment system using such large-current fuse, however, if any abnormality should occur in the load such as power window, or if abnormality should occur in the wire harness of the like connecting the battery and each load, it is set so as not to melt down unless a current large than the preset allowable value flows in the large-current fuse.

Recently, various protective devices have been developed for cutting off between the battery and wire harness by detecting when a large current close to the allowable value is flowing continuously.

SUMMARY OF THE INVENTION

According to the investigation by the present inventors, a protective device as shown in FIG. 10 is considered.

FIG. 10 is a sectional view showing an example of protective device using a bimetal.

Such protective device comprises a housing 103 made of an insulating resin or the like, and forming a fuse compartment 102 at the upper side, a lid 113 for opening and closing the fuse compartment 102 of the housing 103, a power source terminal 105 disposed at the lower side of the housing 103 so that its upper end portion projects into the fuse compartment 102, and the lower end exposed outside, with the portion exposed outside connected to a positive terminal of a battery 104, and a load terminal 109 disposed at the lower side of the housing so that its upper end portion projects into the fuse compartment 102, and the lower end exposed outside, with the portion exposed outside connected to a load 108 through a wire 107 for composing a wire harness 106.

Such protective device further comprises a fusible element 110 made of a low melting point metal disposed in the fuse compartment 102, with one end connected to the upper end of the power source terminal 105, and other end connected to the upper end of the load terminal 109, an intermediate terminal 111 disposed at an intermediate position of the power source terminal 105 and load terminal 109, with the lower end disposed at the lower side of the housing 103 so as to be exposed outside, and the portion exposed outside connected to a negative terminal of the battery 104, and a bimetal 112 made of two long plate members of different metals glued together, with the lower end side connected to the upper end of the intermediate terminal 111 and the upper end side being bent in an L-shape and disposed oppositely to the fusible element 110.

In such constitution, by manipulation of an ignition switch or the like of the vehicle, while a current is flowing in a route of positive terminal of battery 104, power source terminal 105, fusible element 110, load terminal 109, wire 107 of wire harness 106, load 108, and negative terminal of battery 104, if any abnormality should occur in the load 108 or the wire harness 106 connecting the load 108 and the protective device 101, and a current exceeding the allowable value should flow in the fusible element 110, it is heated and melted down.

As a result, the circuit is cut off, and the load 108 and wire harness 106 are protected.

Or when a large current flows in the fusible element 110 due to some abnormality occurring in the load 108 or the wire harness 106 connecting the load 108 and protective device 101, if it does not exceed the allowable value, the fusible element 110 is heated by the current flowing in the fusible element 110, and the bimetal 112 begins to deform. In a specified time after a large current begins to flow in the fusible element 110, the leading end of the bimetal 112 contacts with the fusible element 110, and a large short-circuit current flows in the fusible element 110 in a route composed of positive terminal of battery 104, power source terminal 105, fusible element 110, intermediate terminal 111 and negative terminal of battery 104, so that it is melted down.

As a result, if lower than the allowable value, when a certain current flows longer than a preset time, the circuit is cut off, and the wire harness 106 and load 108 are protected.

Aside from such protective device 101, a protective device 121 shown in FIG. 11 is also devised by the present inventor.

The protective device 121 shown in FIG. 11 comprises a housing 122 made of insulating resin or the like, a power source terminal 124 buried at one side of the housing 122, with the lower end portion connected to a positive terminal of a battery 123, and a load terminal 128 buried at other side of the housing 122, with the lower end portion connected to a load 127 through a wire 126 composing a wire harness 125.

Moreover, one end of a wire 131 composed of a fusible conductor 129 made of a low melting point metal or the like formed in a U-shape and a heat resistant covering 130 formed to cover the fusible conductor 129 is connected to the upper end of the power source terminal 124, and other end is connected to the upper end of the load terminal 128. This wire 131 has a coil 132 made of a shape memory alloy, showing a shape being wound around the wire 131 as shown in FIG. 9 when it is in martensite phase, and returning to the mother phase in a shape of tightening the wire 131 when heated to temperature of 120° C. to 170° C.

Further, outside of the housing 122, there is an external terminal 133 with the upper end connected to one end of the coil 132 and lower end connected to a negative terminal of the battery 123.

In such constitution, by manipulation of an ignition switch or the like of the vehicle, while a current is flowing in a route of positive terminal of battery 123, power source terminal 124, fusible element 129 of wire 131, load terminal 128, wire 126 of wire harness 124, load 127, and negative terminal of battery 123, if any abnormality should occur in the load 127 or the wire harness 125 connecting the load 127 and the protective device 121, and a current exceeding the allowable value should flow in the fusible element 129, it is heated and melted down.

As a result, the circuit is cut off, and the load 127 and wire harness 125 are protected.

Or when a large current flows in the fusible conductor 129 due to some abnormality occurring in the load 127 or the wire harness 125 connecting the load 127 and protective device 121, if it does not exceed the allowable value, the fusible conductor 129 is heated by the current flowing in the fusible conductor 129, and the temperature of the coil 132 climbs up. In a specified time after a large current begins to flow in the fusible conductor 129, when the temperature of the coil 132 reaches 120° C. to 170° C., the coil 132 is shifted from the martensite phase to the mother phase, and bites into the heat resistant covering 130 softened by heat, an contacts with the fusible conductor 129, and a large short-circuit current flows in the fusible conductor 129 in a route composed of positive terminal of battery 123, power source terminal 124, fusible conductor 129, coil 132, external terminal 133 and negative terminal of battery 123, so that it is melted down.

As a result, if lower than the allowable value, when a certain current flows longer than a preset time, the circuit is cut off, and the wire harness 125 and load 127 are protected.

In these protective devices 101 and 121, however, the following problems have been disclosed.

First, in the protective device shown in FIG. 10, since flow of large current in the fusible element 110 is detected by using the bimetal 112 gluing two kinds of metals differing in the coefficient of thermal expansion, if the magnitude of the current flowing in the fusible element 110 changes, the bimetal 112 is deformed, and the time until cutting off the circuit varies.

Accordingly, in the event of such an abnormality that a large current flows intermittently, the temperature of the fusible element 101 does not rise higher than a certain point, and the protective device 101 may not cut off the circuit appropriately.

On the other hand, in the protective device 121 shown in FIG. 11, since flow of large current in the fusible conductor 129 is detected by using the coil 132 made of shape memory alloy, if the magnitude of the current flowing in the fusible conductor 129 changes, the coil 132 is deformed, and the time until cutting off the circuit varies.

Accordingly, in the event of such an abnormality that a large current flows intermittently, the temperature of the fusible conductor 129 does not rise higher than a certain point, and the protective device 121 may not cut off the circuit appropriately.

Besides, in the protective devices shown in FIG. 10 and FIG. 11, it may be also supposed that the heat reaction time of the thermal deformation conductive members such as bimetal 112 and coil 132 may vary depending on the flowing current. Or, the heat reaction of the thermal deformation conductive members may fail to take place timely in case of abnormality of passing of overcurrent.

The invention is devised on the basis of such investigations, and it is hence an object thereof to present a circuit breaker capable of protecting electric parts by cutting off the circuit in a short time and securely in case an abnormal signal is fed into the vehicle.

The circuit breaker of the invention comprises a first connection terminal, a second connection terminal, a heat generating part having conductivity disposed between the first connection terminal and second connection terminal, an igniting part igniting depending on a cut-off signal, an expandable elastic member capable of applying a force to the heat generating part so as to be departed from between the first connection terminal and second connection terminal, and a holding part for holding the elastic member in compressed state. Herein, when the heat generating part is positioned between the first connection terminal and second connection terminal while the holding part is compressing the elastic member, the conductive state between the first connection terminal and second connection terminal is maintained, and as the igniting part ignites depending on the cut-off signal and the heat generating part generates heat, when the holding part releases the elastic member, the elastic member applies force to the heat generating part, and the heat generating part is departed from between the first connection terminal and second connection terminal, the conductive state between the first connection terminal and second connection terminal is cut off.

In this constitution, when the igniting part ignites by a failure signal from outside, the heat generating part generates heat, and by this heat the holding part is melted. As a result, the compressed elastic member is expanded to kick up the heat generating part, and the electric connection between the first connection terminal and second connection terminal is cut off. As the electric connection between the first connection terminal and second connection terminal is cut off, the circuit is securely cut off in a short time, so that the electric parts can be protected.

Herein, the holding part contains a resin part, preferably, and the resin part is melted as the igniting part ignites depending on the cut-off signal and the heat generating part generates heat, so that holding of the conductive part is released quickly.

More preferably, the heat generating part, igniting part and elastic member are contained in an outer container, and therefore the constitution is simple and the operation is secure.

Specifically, the holding part may be a rivet member coupled to the outer container.

In such a case, as the elastic member, a telescopic spring composed of plural slave springs differing diameter disposed concentrically may be preferably used. Since the telescopic spring is fixed to the rivet member in the compressed state, the height direction is lowered as compared with the usual compression spring, so that the circuit breaker may be reduced in size.

The holding part may be a resin member having a base part, a frame part coupled to the base part and wound with an elastic member, and a stopping part formed at the end of the frame part and stops the elastic member in a state of compressing the elastic member, so that the external force is not applied to the junction of the first connection terminal, second connection terminal and heating part.

In such a case, the outer container has an upper case and a lower case, the upper case covers the lower case, an opening is formed in the lower case, and the resin member wound with the elastic member may be constituted so as to be inserted into the opening. The entire structure may be assembled easily, and after cut-off the circuit, the lower case may be used again only by replacing the resin member and the heating part.

On the other hand, a side wall is formed at the end of the heat generating part, and the end of the first connection terminal and the side wall, and the end of the second connection terminal and the side wall may be individually joined with low melting point materials.

In such constitution, usually, the conduction between the first connection terminal and second connection terminal is improved by the low melting point material, and in case of abnormality, the low melting point material is melted securely by the heat generation of the heating agent, and the electric connection between the first connection terminal and second connection terminal is cut off by the rotating force of the elastic material. Usually, meanwhile, since rotating force is not applied to the low melting point material, the reliability of junction between the first connection terminal and second connection terminal is enhanced.

The low melting point material is preferred to be one selected from the group consisting of Sn, Pb, Zn, Al and Cu.

The heat generating part contains the heating agent, and the heating agent is preferred to contain a thermite compound mixing powder of metal oxide and powder of aluminum because the thermite reaction heat can be securely generated by the thermite reaction.

In other words, the heat generating part contains the heating agent, and the heating agent contains at least one metal powder selected from the group consisting of B, Sn, Fe, Si, Zr, Ti and Al, and at least one metal oxide selected from the group consisting of CuO, $MnO_2$, $Pb_3O_4$, $PbO_2$, $Fe_3O_4$, $Fe_2O_3$ and $Cr_2O_3$.

Further, the heating agent may also contain additives having alumina, bentonite or talc.

DETAILED DESCRIPTION OF THE PREFERRED EMBODIMENTS

Figure 1:
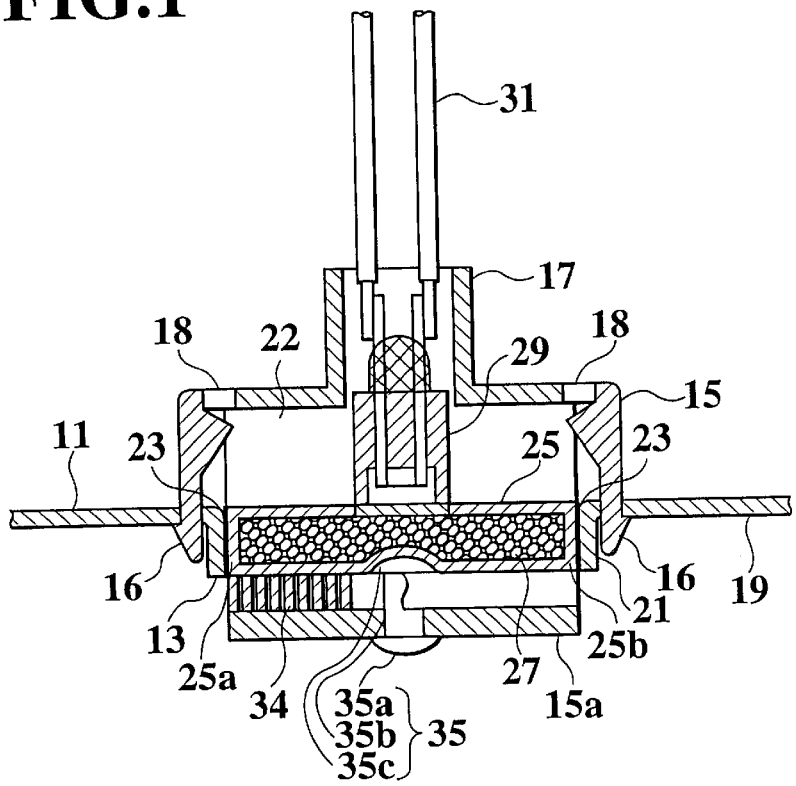
FIG. 1 is a sectional view before cut-off along line A—A' of FIG. 2 of a circuit breaker in an embodiment of the invention.
Figure 2:
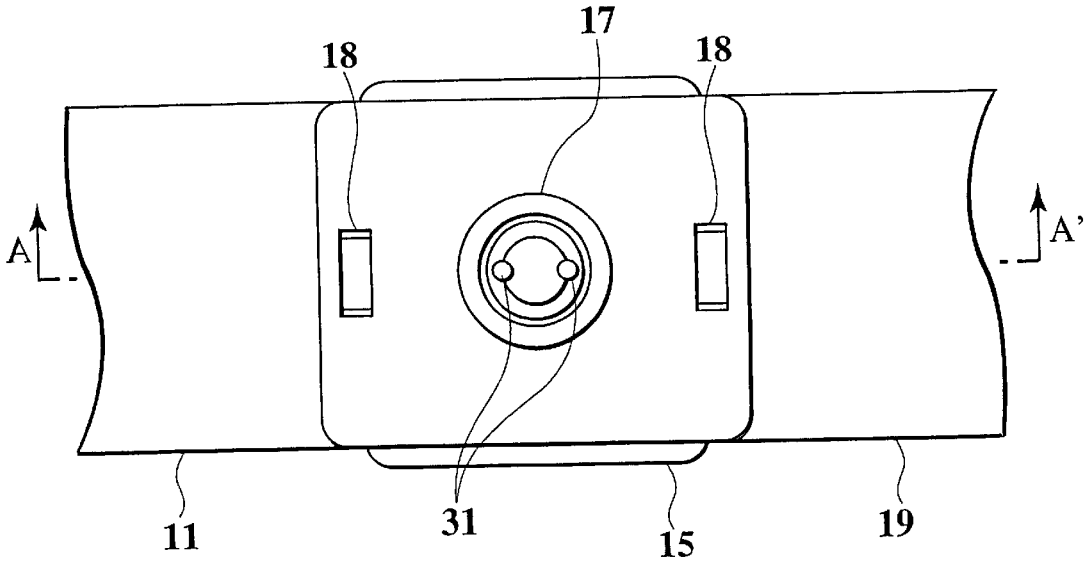
FIG. 2 is a top view of the circuit breaker.

Referring now to the drawings, preferred embodiments of the invention are described in detail below.

A first embodiment of the invention is described below.

In the circuit breaker shown in FIG. 1, a first bus bar 11 of a long plate form is preferably made of copper or copper alloy, and is connected to a battery not shown or the like, and a leading end 13 of the first bus bar 11 is bent downward nearly at right angle.

A second bus bar 19 of a long plate form is also preferably made of copper or copper alloy, and is connected to a load not shown or the like, and a leading end 21 of the second bus bar 19 is also bent downward nearly at right angle.

Between the first bus bar 11 and second bus bar 19, there is an outer case 15 of a square lid form having a case bottom 15*a,* and each leading end 16 of the outer case 15 is fixed and connected nearly to the leading ends of the first bus bar 11 and second bus bar 19 so that the relative position between the first bus bar 11 and second bus bar 19 is determined.

The outer case 15 is made of an insulating material, more specifically a container made of thermoplastic resin or the like, and near the center of the outer case 15, a nearly cylindrical case protrusion 17 is formed, with the upper side being opened, and square holes 18 are formed at right and left ends.

A cavity 22 is formed in the outer case 15, and this cavity 22 contains a thermite case 25 disposed oppositely to the case protrusion 17 of the outer case 15 so as to connect between the first bus bar 11 and second bus bar 19, and this thermite case 25 is filled with a heating agent 27. The thermite case 25 is preferably made of a material high in thermal conductivity and not melted by heat generation of the heating agent 27, for example, brass, copper, copper alloy, or stainless steel. The thermite case 25 is formed in a cylindrical or rectangular parallelepiped shape by drawing process.

The thermite case 25 is located at a height position nearly equal to the height position of the first bus bar 11 and second bus bar 19, and regarding the thermite case 25, further, a left side wall 25*a* and a right side wall 25*b* are formed.

The left side wall 25*a* is joined to the leading end 13 of the first bus bar 11 by means of a low melting point metal 23 of which melting point is 200° C. to 300° C. As the low melting point material, solder is preferably used. The right side wall 25*b* is joined to the leading end 21 of the second bus bar 19 through the low melting point metal 23. Accordingly, the first bus bar 11 and second bus bar 19 can be electrically connected with each other through the low melting point metal 23 and thermite case 25.

As the low melting point metal 23, at least one metal selected from the group consisting of Sn, Pb, An, Al and Cu is preferably used.

The heating agent 27 is a thermite compound composed of powder of metal oxide such as iron oxide ($Fe_2O_3$) and powder of aluminum, which generates high heat by inducting thermite reaction by heat generation of a lead wire 31. This thermite compound is sealed in the thermite case 25 which is a metal container to shut off moisture. Instead of iron oxide ($Fe_2O_3$), chromium oxide ($Cr_2O_3$) or manganese oxide ($MnO_2$) may be used.

The heating agent 27 may be also a mixture composed of at least one metal powder selected from the group consisting of B, Sn, Fe, Si, Zr, Ti and Al, at least one metal oxide selected from the group consisting of CuO, $MnO_2$, $Pb_3O_4$, $PbO_2$, $Fe_2O_4$ and $Fe_2O_3$, and at least one additive selected from the group consisting of alumina, bentonite and talc. By using such heating agent, it is easily ignited by an igniting part 29, and the low melting point metal 23 can be melted in a short time.

At a position confronting the case protrusion 17 in the cavity 22, the igniting part 29 is disposed in contact with the surface of the thermite case 25, and the led wire 31 passing through the case protrusion 17 is connected to this igniting part 29. The igniting part 29 is designed to generated thermite reaction heat in the heating agent 27 by igniting the ignition agent by the heat generated by the current flowing in the lead wire 31 in case of abnormality of vehicle such as collision accident of vehicle.

Between the bottom surface of thermite case 25 and case bottom 15*a,* a telescopic spring 34 is disposed as an expandable flexible member. The telescopic spring 34 may be not only thus disposed near the heating agent 27 through the bottom surface of thermite case 25, but also disposed in direct contact with the heating agent 27 if necessary.

This telescopic spring 34 is composed of plural slave springs 34*a* to 34*n* differing in diameter disposed concentrically. In the state before circuit cut-off shown in FIG. 1, the telescopic spring 34 is compressed and fixed to the case bottom 15*a* by a resin-made rivet 35 having heads 35*a,* 35*c,* and a body 35*b.*

Figure 3:
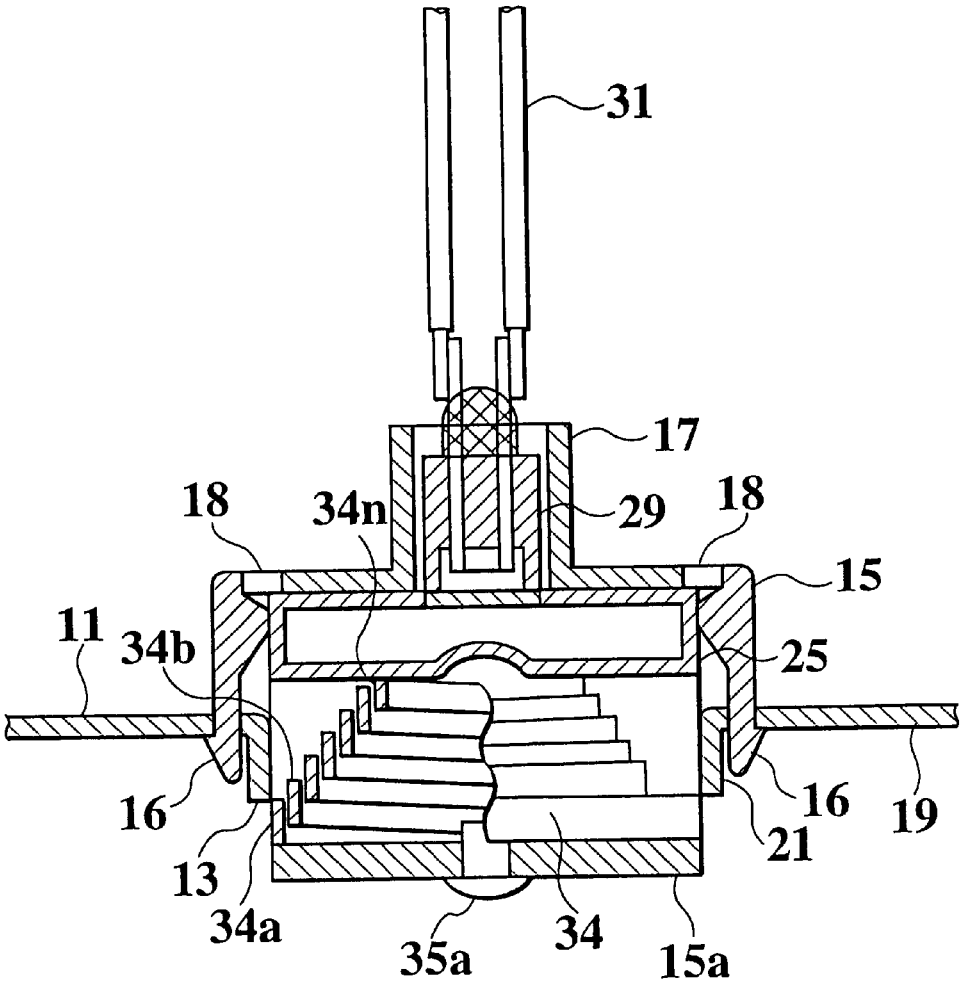
FIG. 3 is a sectional view after cut-off of the circuit breaker.

In the state after circuit cut-off shown in FIG. 3, when the low melting point metal 23 and rivet 35 are heated and melted by the thermite reaction heat of the heating agent 27, the plural slave springs 34*a* to 34*n* differing in diameter disposed concentrically are elongated in steps, and the thermite case 25 and igniting part 29 are kicked up.

In thus constituted circuit breaker of the embodiment, the operation is described below.

Usually, the first bus bar 11 and second bus bar 19 are electrically connected with each other through the low melting point metal 23 and the thermite case 25, and a current is supplied from the battery to the load (neither shown).

If the vehicle collides against an obstacle or tumbles off a cliff or the like, the abnormality of the vehicle is detected by a collision sensor or the like. By detection of such abnormality of vehicle, a current flows into the igniting part 29 through the lead wire 31.

As a result, by heat generation by the current, the igniting part 29 ignites, and the heating agent 27 which is the thermite compound generates thermite reaction heat in the following reaction formula.

$$Fe_2O_3+2Al \rightarrow Al_2O_3+2Fe+386.2 \text{ (kcal)}$$

By this thermite reaction heat, the thermite case 25 is heated, and by the heat generation of the heating agent 27 and the heat of the thermite case 25, the low melting point metal 23 joining the bus bar leading end 13 and the left side wall 25*a* of the thermite case 25, and the low melting point metal 23 joining the bus bar leading end 21 and the right side wall 25*b* of the thermite case 25 are heated and melted. At the same time, the resin-made rivet 35 compressing and fixing the telescopic spring 34 to the case bottom 15*a* is melted by the same heat.

Consequently, as shown in FIG. 3, the plural slave springs 34*a* to 34*n* differing in diameter disposed concentrically are elongated in steps, and the thermite case 25 and igniting part 29 are kicked up.

As a result, the electric connection between the thermite case 25 and the first bus bar 11 and second bus bar 19 is cut off. That is, the first bus bar 11 and second bus bar 19 are electrically cut off, and the electric circuit of the vehicle is cut off.

Thus, according to the circuit breaker of the embodiment, receiving an input of failure signal from the vehicle, the igniting part 29 ignites, the heating agent 27 induces thermite reaction, and the low melting point metal 23 and rivet 35 are melted by this thermite reaction heat, so that the telescopic spring 34 springs up instantly.

Accordingly, the electric circuit of the vehicle can be cut off securely in a short time, and the electric parts can be protected. Moreover, by using the thermite reaction heat of the heating agent 27, the circuit breaker in a simple structure can be presented.

Moreover, since spring force is not applied to the low melting point metal 23 at the junction of the first bus bar 11, second bus bar 19 and thermite case 25, the reliability of the junction can be enhanced.

Further, using the telescopic spring 34 as the spring member, since the resin-made rivet 35 is fixed in the compressed state of the telescopic spring 34, the height direction can be lowered as compared with the constitution of using the ordinary compression spring, so that the circuit breaker can be reduced in size.

In the first embodiment, using the telescopic spring 34 and low melting point metal 23, the circuit is cut off when the rivet 35 and low melting point metal 23 are melted, but without using low melting point metal 23, only the telescopic spring 34 may be provided, and the circuit may be cut off when the rivet 35 is melted.

Figure 4:
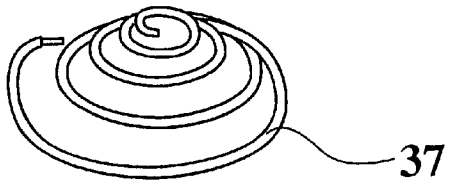
FIG. 4 is a diagram showing an example of using a wire coil spring of the circuit breaker.

As the elastic member, the telescopic spring 34 winding leaf springs is used, but instead of the telescopic spring 34, a coil spring 37 winding a wire spirally as shown in FIG. 4 may be also used.

Figure 5A:
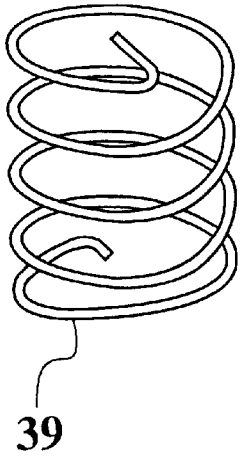
FIG. 5A and FIG. 5B are diagrams showing examples of using compression spring of the circuit breaker.
Figure 5B:
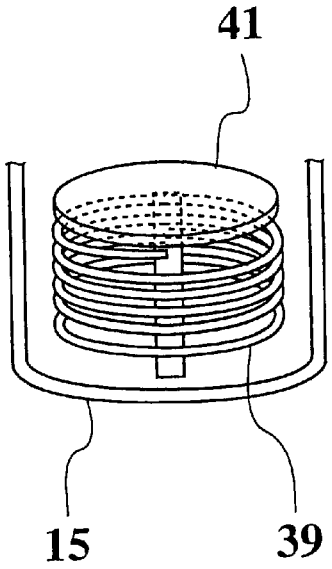

Or, by using a spiral compression spring 39 as shown in FIG. 5A instead of the telescopic spring 34, this compression spring 39 may be put in the outer case 15 as shown in FIG. 5B, and compressed by a disk 41 made of resin member. In such a case, too, when the rivet 35 is melted, the thermite case 25 is kicked up by the spring force of the compression spring 39.

The resin-made rivet 35 for fixing the telescopic spring 34 may be formed integrally with the case bottom 15*a*.

A circuit breaker in a second embodiment of the invention is described below.

Figure 6:
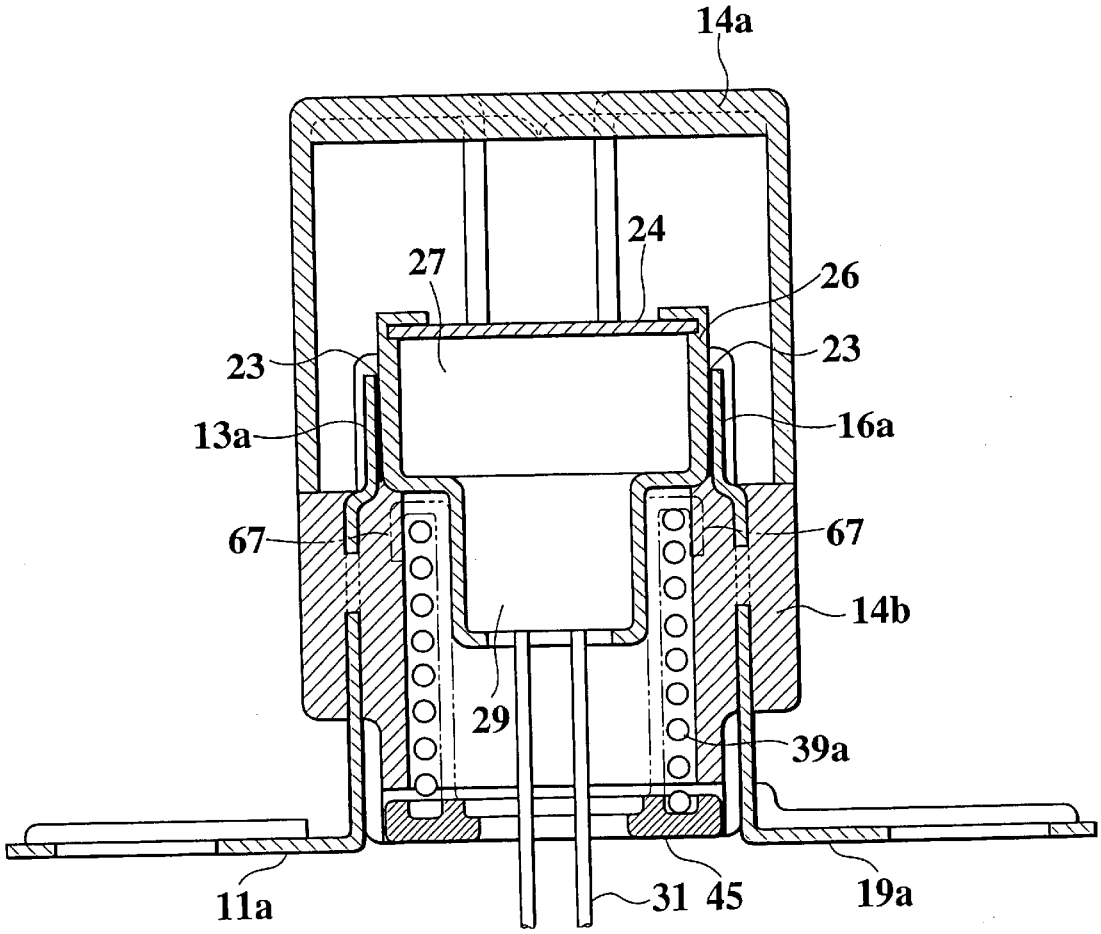
FIG. 6 is a sectional view before cut-off of a circuit breaker in a second embodiment of the invention.
Figure 7:
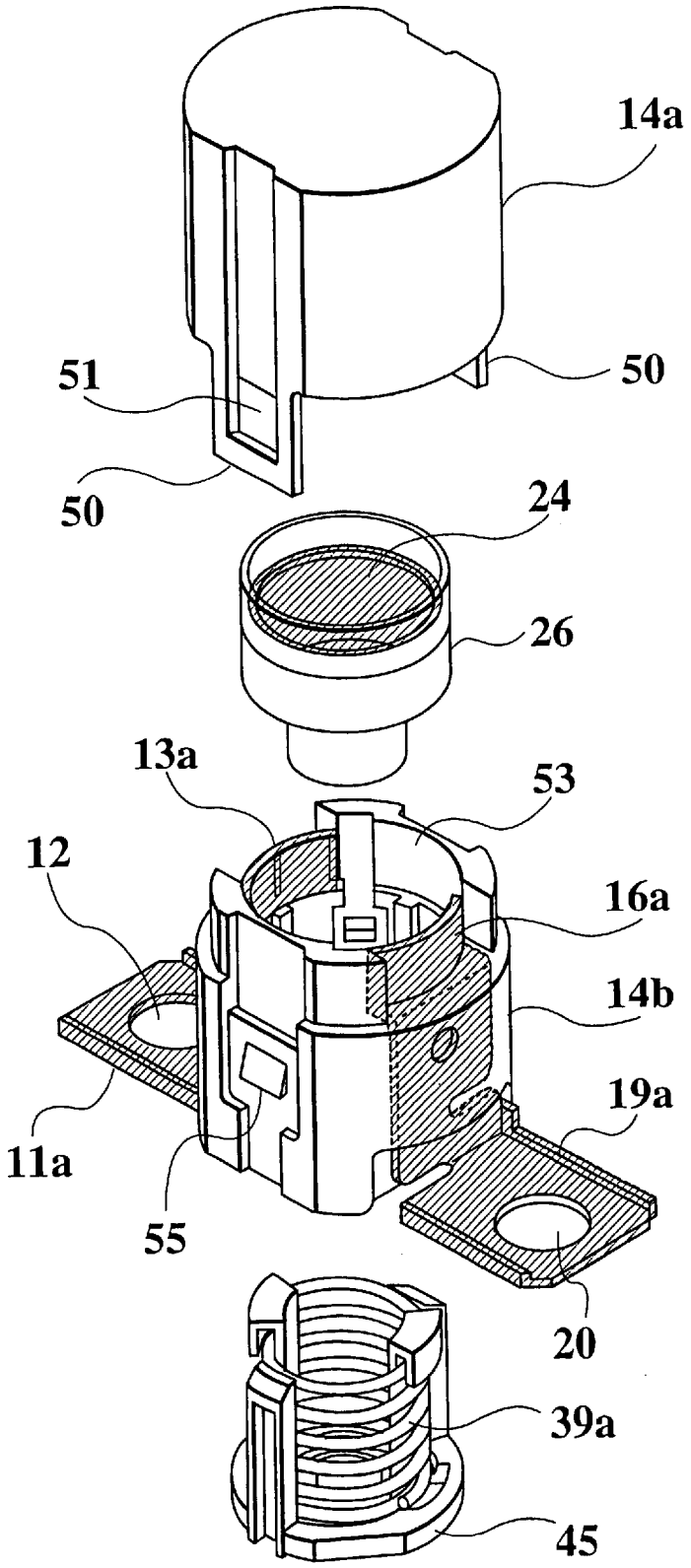
FIG. 7 is a perspective assembly view of the circuit breaker.

As shown in FIG. 6 and FIG. 7, in the circuit breaker of the embodiment, an extension 50 having a square groove 51 is formed inn a cap 14*a,* and a wedge-shaped stopping part 55 is formed in a resin case 14*b,* and as the stopping part 55 fits into the groove 51, the cap 14*a* covers the resin case 14*b.* The cap 15*a* and resin case 14*b* are containers of insulating material, preferably made of thermoplastic resin.

In an opening 53 formed in the resin case 14*b,* a cylindrical thermite case 26 is placed, and this thermite case 26 contains a heating agent 27 and an igniting part 29 having a lead wire 31, and an upper lid 24 is put on the heating agent.

A first bus bar 11*a* having a round hole 12 and a second bus bar 19*a* having a round hole 20 are bent upward nearly at right angle, and the bend portions pass through the resin case 14*b,* and bus bar leading ends 13*a,* 16*a* contact with right and left side walls of the thermite case 26 through the low melting point metal 23.

The right and left side walls of the thermite case 26 are joined to the bus bar leading ends 13*a,* 16*a* through the low melting point metal 23, and the first bus bar 11*a* and second bus bar 19*a* are connected with each other electrically through the low melting point metal 23 and thermite case 26.

Figure 8:
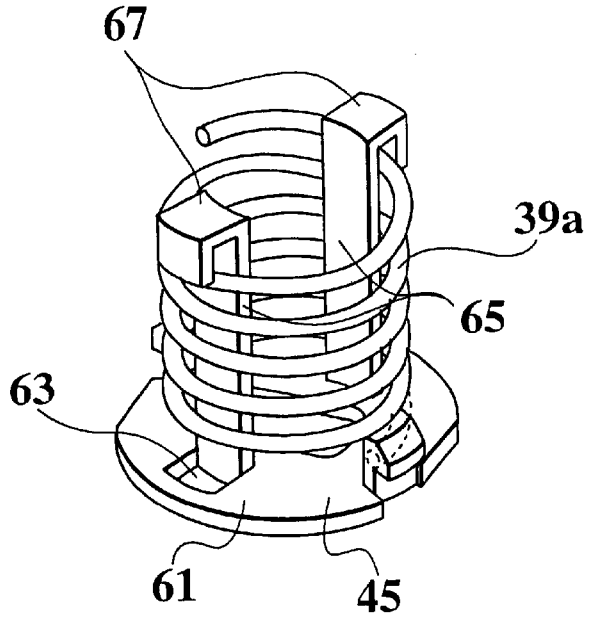
FIG. 8 is a state diagram of retainer before cut-off of the circuit breaker.

In the lower part of the thermite case 26 within the opening 53 of the resin case 14*b,* there is a retainer 45 made of a resin member which is melted by heat generation of the heating agent 27. This retainer 45 is composed of, as shown in FIG. 8, a base part 61, a notch 54 formed in this base part 61, a retainer frame 65 planted on the notch 63 and base part 61, and a retainer stopper 67 formed at the leading end of the retainer frame 65.

Outside of the retainer frame 65, a compression spring 39*a* winding the retainer frame 65 spirally is disposed, and the leading end of this compression spring 39*a* is stopped by the retainer stopper 67. That is, the compression spring 39*a* is fitted into the retainer 45 in the compressed state.

A part of the retainer frame 65 is disposed in contact with the thermite case 26, and the hook of the retainer stopper 67 is engaged with the resin case 14*b.*

In the circuit breaker of this embodiment, the same parts as in the circuit breaker of the first embodiment are identified with same reference numerals, and their detailed description is omitted.

In thus constituted circuit breaker of the second embodiment, the operation is explained below by referring to the accompanying drawings.

Usually, the first bus bar 11*a* and second bus bar 19*a* are electrically connected with each other through the low melting point metal 23 and the thermite case 26, and a current is supplied from the battery to the load (neither shown).

If the vehicle collides against an obstacle or tumbles off a cliff or the like, the abnormality of the vehicle is detected by a collision sensor or the like. By detection of such abnormality of vehicle, a current flows into the igniting part 29 through the lead wire 31.

As a result, by heat generation by the current, the igniting part 29 ignites, and the heating agent 27 generates thermite reaction heat. By this thermite reaction heat, the thermite case 26 is heated, and by the heat generation of the heating agent 27 and the heat of the thermite case 26, the low melting point metal 23 is heated and melted.

Figure 9:
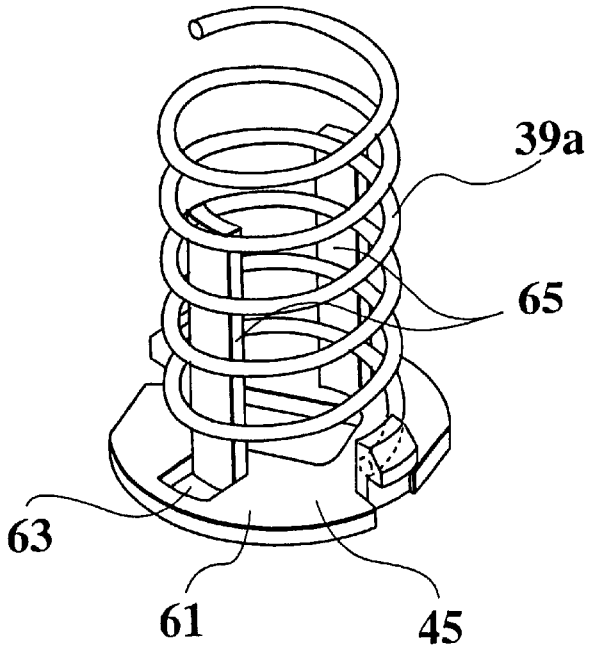
FIG. 9 is a state diagram of retainer after cut-off of the circuit breaker.
Figure 10:
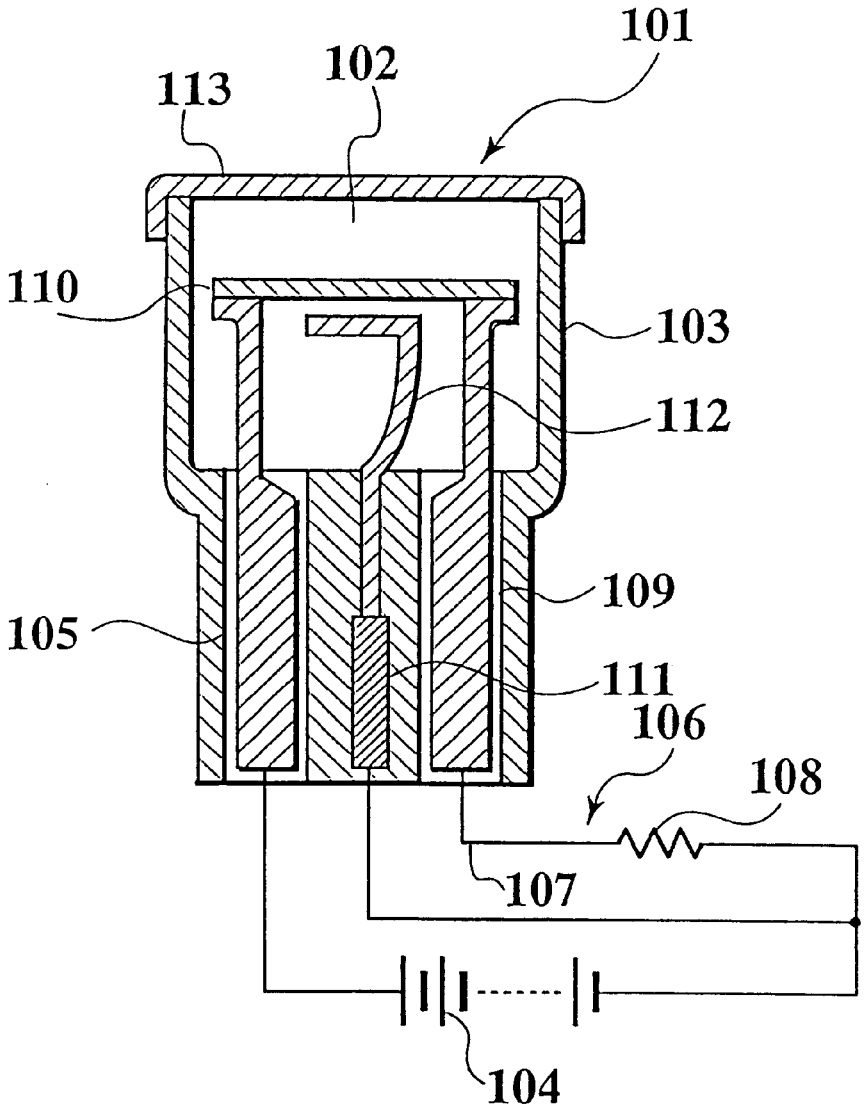
FIG.10 PRIOR ART
FIG. 10 is a sectional view showing an example of protective device using bimetal.
Figure 11:
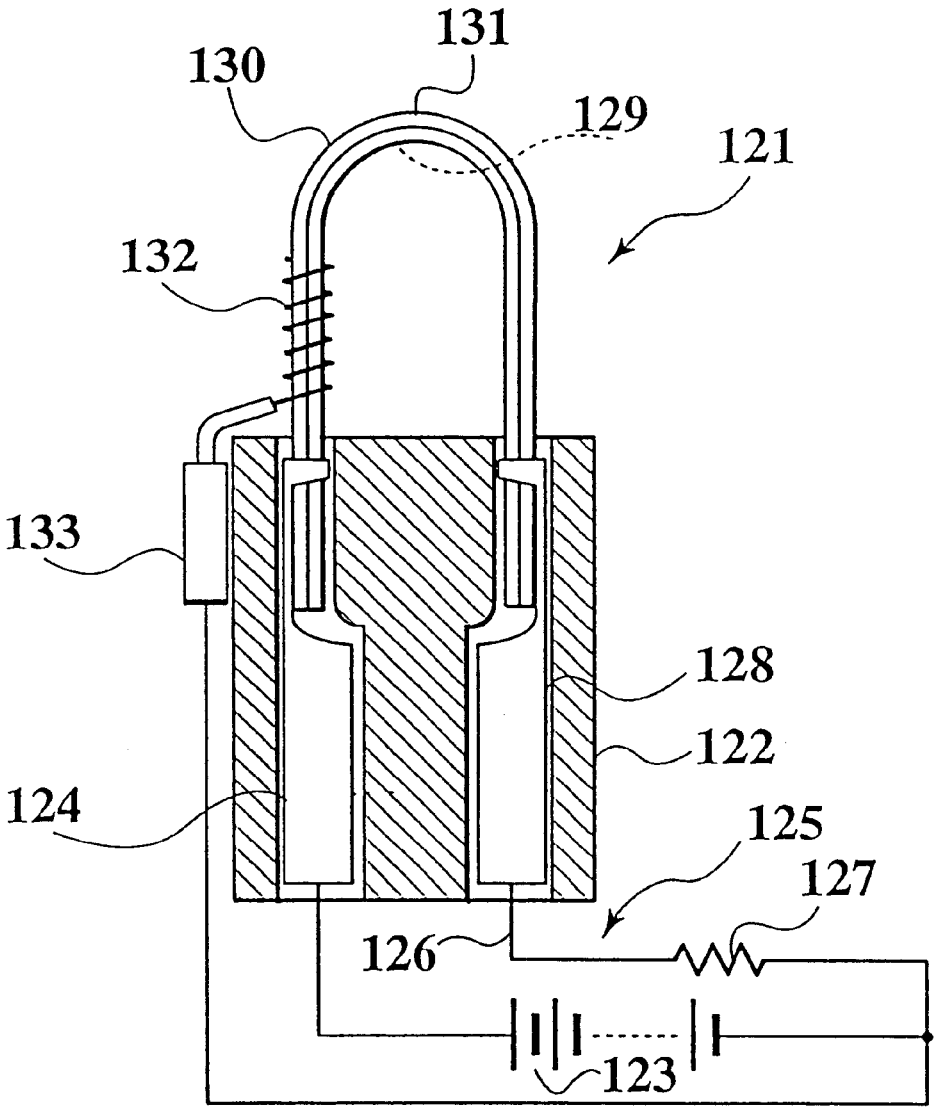
FIG.11 PRIOR ART
FIG. 11 is a sectional view showing other example of protective device.

At the same time, the resin-made retainer stopper 67 having the compression spring 39*a* compressed and fixed to the retainer 45 is melted by the same heat. Consequently, as shown in FIG. 9, the compression spring 39*a* is elongated, and the thermite case 26 is kicked up.

Accordingly, the electric connection between the thermite case 26 and the first bus bar 11*a* and second bus bar 19*a* is cut off. That is, the electric circuit of the vehicle is cut off.

Thus, according to the circuit breaker of this embodiment, too, the same effects as in the circuit breaker of the first embodiment are obtained.

Moreover, since the compression spring 39*a* is held by the retainer 45, external force is not applied to the junction of the first bus bar 11*a,* second bus bar 19*a* and thermite case 26.

Still more, since the sub-assembly of the compression spring 39*a* and retainer 45 are inserted from the lower side, that is, from the lower side of the opening 53 of the resin case 14*b,* the circuit breaker can be assembled easily.

After the circuit is cut off, only by replacing the retainer 45 and thermite case 26, the resin case 14*b* can be recycled and used as fuse.

In the second embodiment, using the compression spring 39*a* and low melting point metal 23, the circuit is cut off when the retainer 45 and low melting point metal 23 are melted, but without using the low melting point metal 23, only the retainer 45 may be provided, and the circuit may be cut off when the retainer 45 is melted.

Besides, these embodiments may be further changed and modified in various forms without departing from the technical scope of the invention.

What is claimed is:

1. A circuit breaker comprising:

a first connection terminal;

a second connection terminal;

a heat generating part having conductivity disposed between said first connection terminal and said second connection terminal;

an igniting part igniting depending on a cut-off signal;

an expandable elastic member capable of applying a force to said heat generating part so as to be departed from between said first connection terminal and said second connection terminal; and a holding part holding said elastic member in compressed state, wherein when said heat generating part is positioned between said first connection terminal and said second connection terminal while said holding part is compressing said elastic member, a conductive state between said first connection terminal and said second connection terminal is maintained, and as said igniting part ignites depending on said cut-off signal and said heat generating part generates heat, when said holding part releases said elastic member, said elastic member applies said force to said heat generating part, and said heat generating part is departed from between said first connection terminal and said second connection terminal, said conductive state between said first connection terminal and said second connection terminal is cut off.

2. A circuit breaker according to claim 1, wherein said holding part contains a resin part, and said resin part is melted as said igniting part ignites depending on said cutoff signal and said heat generating part generates said heat.

3. A circuit breaker according to claim 2, wherein said heat generating part, said igniting part and said elastic member are contained in an outer container.

4. A circuit breaker according to claim 3, wherein said holding part is a rivet member communicating to said outer container.

5. A circuit breaker according to claim 4, wherein said elastic member is a telescopic spring composed of plural slave springs differing in diameter disposed concentrically.

6. A circuit breaker according to claim 3, wherein said holding member is a resin member having a base part, a frame coupled to said base part and winding said elastic member around, and a stopping part formed at an end of said frame and stopping said elastic member in compressed state.

7. A circuit breaker according to claim 6, wherein said outer container has an upper case and a lower case, said upper case covers said lower case, an opening is formed in said lower case, and said resin member winding said elastic member around can be inserted into said opening.

8. A circuit breaker according to claim 1, wherein a side wall is formed at an end of said heat generating part, and an end of said first connection terminal and said side wall, and an end of said second connection terminal and said side wall are individually joined with a low melting point material.

9. A circuit breaker according to claim 8, wherein said low melting point material is at least one selected from the group consisting of Sn, Pb, Zn, Al and Cu.

10. A circuit breaker according to claim 1, wherein said heat generating part contains a heating agent, and said heating agent contains a thermite compound mixing powder of metal oxide and powder of aluminum.

11. A circuit breaker according to claim 1, wherein said heat generating part contains a heating agent, said heating agent contains at least one metal powder selected from the group consisting of B, Sn, Fe, Si, Zr, Ti and Al, and at least one metal oxide selected from the group consisting of CuO, $MnO_2$, $Pb_3O_4$, $PbO_2$, $Fe_3O_4$, $Fe_2O_3$ and $Cr_2O_3$.

12. A circuit breaker according to claim 11, wherein said heating agent further contains an additive having alumina, bentonite or talc.

* * * * *